United States Patent [19]

Fedij

[11] Patent Number: 4,545,286

[45] Date of Patent: Oct. 8, 1985

[54] ACTIVE ARMOR

[76] Inventor: Victor Fedij, 1534 Mulloy Dr., Addison, Ill. 60101

[21] Appl. No.: 620,509

[22] Filed: Jun. 14, 1984

[51] Int. Cl.[4] ..... F41N 5/04; F41N 5/16

[52] U.S. Cl. ..... 89/36.02; 89/36.08; 109/85; 428/911

[58] Field of Search ..... 89/36 A, 36 H, 36 J, 89/36 K, 36 L, 36 Z, 36 AE; 114/9-12, 14; 109/81, 82, 85, 80; 428/437, 911, 451, 524

[56] References Cited

U.S. PATENT DOCUMENTS

| | | | |
|---|---|---|---|
| 92,302 | 7/1869 | Giambastiani | 109/81 |
| 194,053 | 8/1877 | Rowlinson | 109/85 |
| 1,287,910 | 12/1918 | de Rosa | 109/81 |
| 1,294,920 | 2/1919 | Lemiszczak | 89/36 A |

*Primary Examiner*—Stephen C. Bentley
*Assistant Examiner*—John S. Maples
*Attorney, Agent, or Firm*—Stephen A. Litchfield; Carmen B. Patti

[57] ABSTRACT

This disclosure depicts a novel apparatus for providing protection to armored personnel carriers such as tanks, or other military vehicles. The invention comprises a series of rectangular armor plates mounted to the surface area of the vehicle. The armor plates adjacent one another and each plate is secured to the tank surface by a threaded fastener. The threaded fasteners maintain the plates a predetermined distance from the tank surface and maintains the plates in a substantially parallel relationship to the surface of the tank wall. Each plate has three separate tiles adhered together, one tile comprising a steel material, one tile a soft material and one tile a thermally dissipating ceramic. The means for mounting the plates to the tank surface are designed such that the energy required to break the threaded fastener upon impact by a projectile is less than the energy required for the projectile to penetrate the plate.

15 Claims, 16 Drawing Figures

ACTIVE ARMOR

BACKGROUND OF THE INVENTION

This invention relates to active armor for personnel carriers such as tanks. In particular this invention relates to means for protecting the surface area of the personnel carrier from attack and penetration of armor by various types of anti-tank projectiles.

In a war zone it is desirable to protect the personnel operating military vehicles. Military personnel carriers include tanks, jeeps, trucks, ships, and aircraft. Most traditional armor against anti-personnel carrier rounds has been "passive." Passive armor generally is a structural component of the vehicle wall and does not react actively to the strike of an anti-personnel carrier round. For the purposes herein the vehicle carrier described will be a tank. However, it should be realized that many other types of personnel carriers and vehicles are used in a military application to which the instant invention will apply. There are three general types of anti-tank missiles. The first is an armor piercing kinetic round also known as a kinetic penetrator or a sabot round. The sabot round consists of a very narrow, elongate, and dense projectile propelled at an extremely high velocity by a gas explosion. In flight, the sabot round has a flight vector consistent with the central axis of the round. The projectile does not contain an explosive charge, however, due to its extreme density it quickly penetrates the tank armor where it then ricochets off the interior of the tank walls, killing or wounding the personnel inside. In the past, in an effort to defeat the sabot round, sandbags or other types of materials have been placed over the tank armor. The sandbags were placed over the tank walls in an effort to cause the projectile to strike the soft material and be deflected off of its flight vector such that the round spins out of the way. As can be readily appreciated the "sandbag" method didn't always work, leading to disastrous results.

The next type of anti-tank round is called a "shaped charge." This missile strikes the tank wall and detonates. A high-intensity explosion occurs within the charge. The heat energy of the explosion is tunneled through a narrow, elongate portion of the charge, generating an extreme heat. This heat burns through the armor wall of the tank and causes a heat explosion inside the tank, which will incinerate the personnel inside. Again, sandbags have been used in an effort to defeat the shaped charge. Also, in other attempts to defeat the shaped charge, an outer layer of metal has been welded to the tank surface which leaves an open inner area between the outer layer and the tank surface. This method provided some relief from a shaped charge, however, it provided no protection from a sabot round.

A third type of anti-tank round is a high explosive plastic charge also called a "HESH charge." HESH stands for high explosive squish head. This charge consists of a missile with a plastic explosive head. It strikes the tank armor and spreads a layer of explosive charge over an area of the tank armor. The charge then explodes. While this explosion does not penetrate the tank armor, it does set up a shock wave which causes the inner tank armor wall to fracture and explode inward thereby killing or wounding the personnel inside.

In the past while there have been attempts at creating various types of armament to avoid the effects of these types of charges, there has been difficulty in arriving at a means of protecting against all three types of charges.

Most traditional methods of armament have protected against one type of charge or another, but not against all three types. Thus, there is a need for an armament which will help protect a personnel carrier such as a tank from a sabot projectile, a shaped charge projectile and a HESH charge projectile.

SUMMARY OF THE INVENTION

It is an object of the present invention to provide an armament for a personnel carrier which will effectively withstand the sabot type projectile. It is another object of the present invention to provide an armament for a personnel carrier such as a tank that will effectively withstand the shaped charge projectile.

It is another object of the present invention to provide an armament that will protect effectively against a HESH charge projectile.

It is a further object of the invention to provide a tank armament which is quickly and easily replaced once damaged.

It is an additional object of the invention to provide a tank armament which will not otherwise affect the operation of the tank or personnel carrier.

Further objects and advantages of the invention will in part become apparent as the following description proceeds. The features of novelty which characterize the invention will be pointed out with particularity in the claims annexed to and forming a part of this specification.

The objects above stated are accomplished by providing a series of rectangular shaped armor plates, or plates of a suitable other shape, placed approximately adjacent each other over crucial areas of the tank armor surface. Each armor plate has connected thereto a threaded bolt at the approximate center of the plate. The armor plate is connected to the tank surface by the threaded bolt. The armor plate comprises three separate tiles adhered together. A central tile is composed of a rectangular shaped piece of hard plate steel or other dense metal. The steel may be as much as a half inch or more in thickness. The steel has a front planar portion and a back planar portion, both planar portions are parallel to one another. Attached to the front planar portion of the hard steel tile is a tile of a relatively soft, deformable material. A recommended application for this soft, deformable tile would be copper, bronze, a metal alloy, such as an aluminum alloy, or even a plastic polymer. The thickness of this soft material would be in the area of two-and-a-half times the thickness of the steel tile. On the back planar portion of the steel tile is secured a tile having heat dissipating properties. Such a tile could consist of a ceramic material.

The central steel tile is attached to a threaded bolt at the head of the bolt. The bolt is disposed approximately at the center of the area of the steel tile, i.e., at approximately the point of intersection of lines connecting the diagonal corners of the tile. The threaded end of the bolt is threaded into a threaded opening on the tank armor wall or surface. The threaded bolt maintains the armor plate a predetermined distance from the tank armor surface. Further, it keeps the series of armor plates approximately parallel to the immediate underlying surface of the tank armor.

Centrally located on the steel tile is an elongate plug having a pointed end. This plug is axially aligned with the threaded bolt such that the pointed end protrudes out of the soft, elastic tile material. The plug is made of a steel or other dense metal and is friction fitted into the tiles.

A spacer is provided between the hard steel tile and the tank surface. The spacer has a convex outer shape, in the form of a bowl, adjacent the surface of the tank wall. The spacer is made of a steel or other dense metal and is welded or fused onto the steel tile.

With respect to the sabot round, when it strikes the armor plate, it is imbedded immediately in the relatively soft, elastic outer tile and then it strikes the hard steel tile. So long as the sabot projectile strikes the armor plate off center, a rotational force is exerted on the plate where it is secured to the threaded bolt. The threaded bolt is designed such that it will break prior to allowing the penetration of the hard steel tile by the projectile, thus, the entire armor plate is immediately tilted as the threaded fastener breaks. This tilt causes the line of flight of the projectile to be disoriented from the central axis of the sabot round, thereby throwing the sabot round off its line of flight and causing it to flip or spin out away from the tank.

When the shaped charge hits the armor plate it is imbedded in the soft, elastic tile and it detonates. The shaped charge will then explode and burn through the hard steel tile. However when it reaches the thermally dissipating ceramic tile the heat energy from the shaped charge will be spread over the entire tile rather than concentrated over a small area as required to successfully penetrate the tank armor. Thus, the shaped charge will not penetrate the tank armor. Also, since the threaded fastener maintains the armor plates a predetermined distance from the tank surface, the heat energy of the shaped charge will not reach the tank wall. Thus the armor plate provides a dual means for rendering the shaped charge ineffective.

The HESH charge will strike the soft, elastic outer tile and will spread its plastic explosive over that plate and perhaps a few adjacent armor plates. When the plastic explosive detonates only the armor plates surrounded by the plastic explosive will be affected. Since the armor plates are removed a predetermined distance from the armor surface of the tank by the fastener, the required shock waves cannot be set up to create the fracture explosion inside of the tank.

Thus, the above provides a means for protecting an armor tank or other military vehicle against the three most common types of anti-tank rounds.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof, and wherein.

FIG. *2a* is a front and side perspective view of a single plate.

FIG. *2b* is a back and side perspective view.

Figure 3:
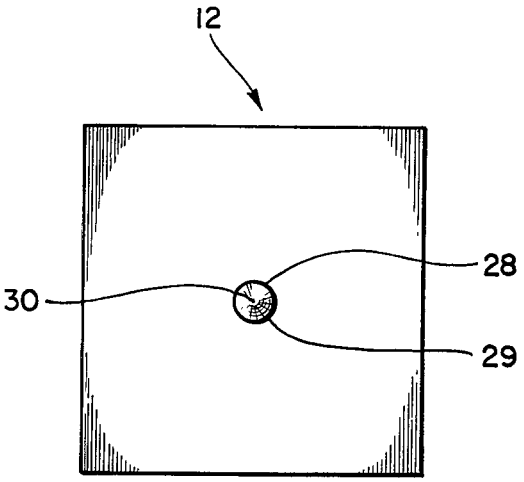

FIG. 3 is a front view of a single armor plate.

Figure 4:
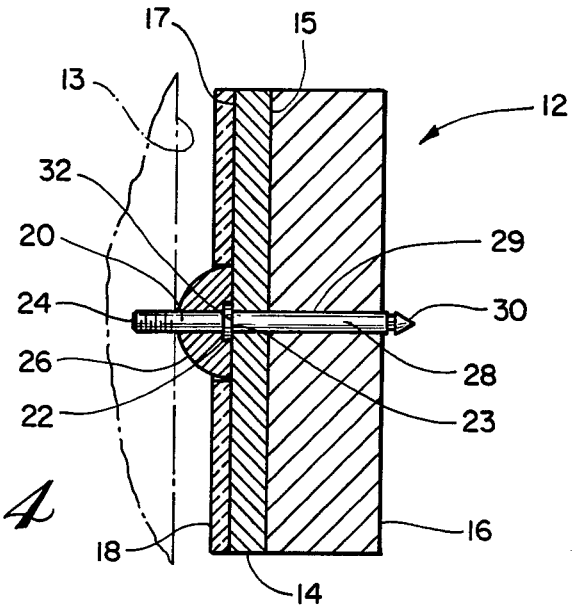

FIG. 4 is a side view of a single armor plate.

Figure 5:
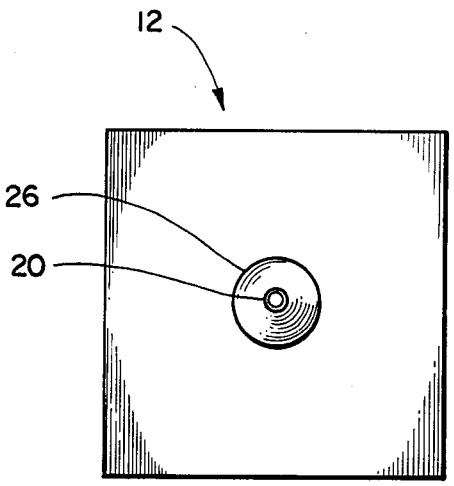

FIG. 5 is a back view of a single armor plate.

FIGS. *6a* through *6e* show a sequence of views in which an elongate projectile strikes an armor plate mounted to an armor surface.

FIGS. *7a* and *7b* illustrate a sequence of views of a shaped charge hitting an armor plate mounted to an armor surface.

FIGS. *8a* and *8b* illustrate a sequence of views of a HESH charge hitting an armor plate mounted to an armor surface.

Figure 9:
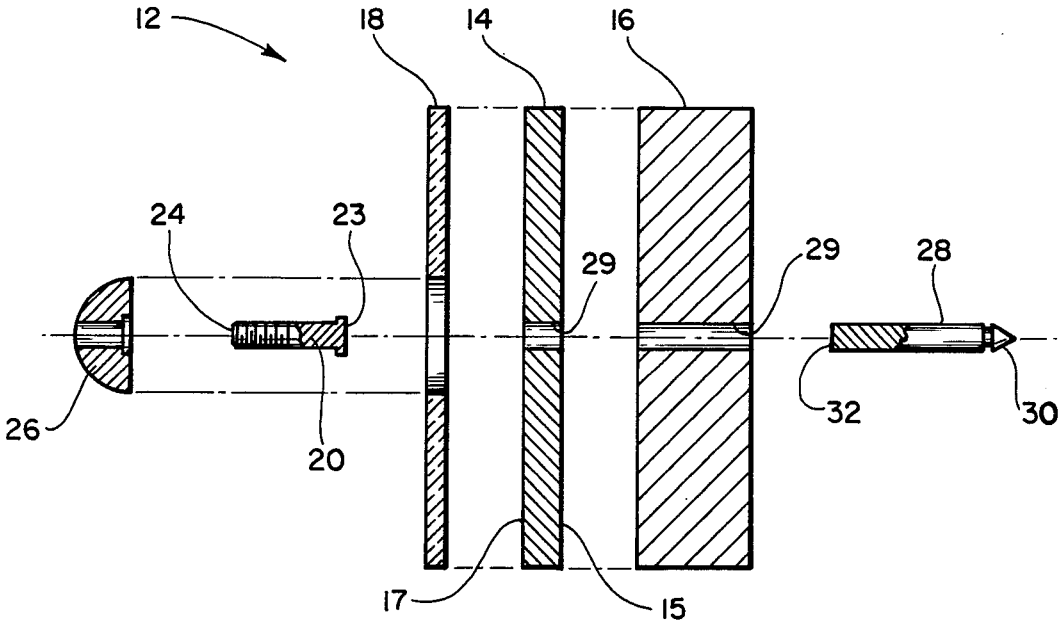

FIG. 9 illustrates an exploded view of the component parts of the instant invention.

DETAILED DESCRIPTION

Figure 1:
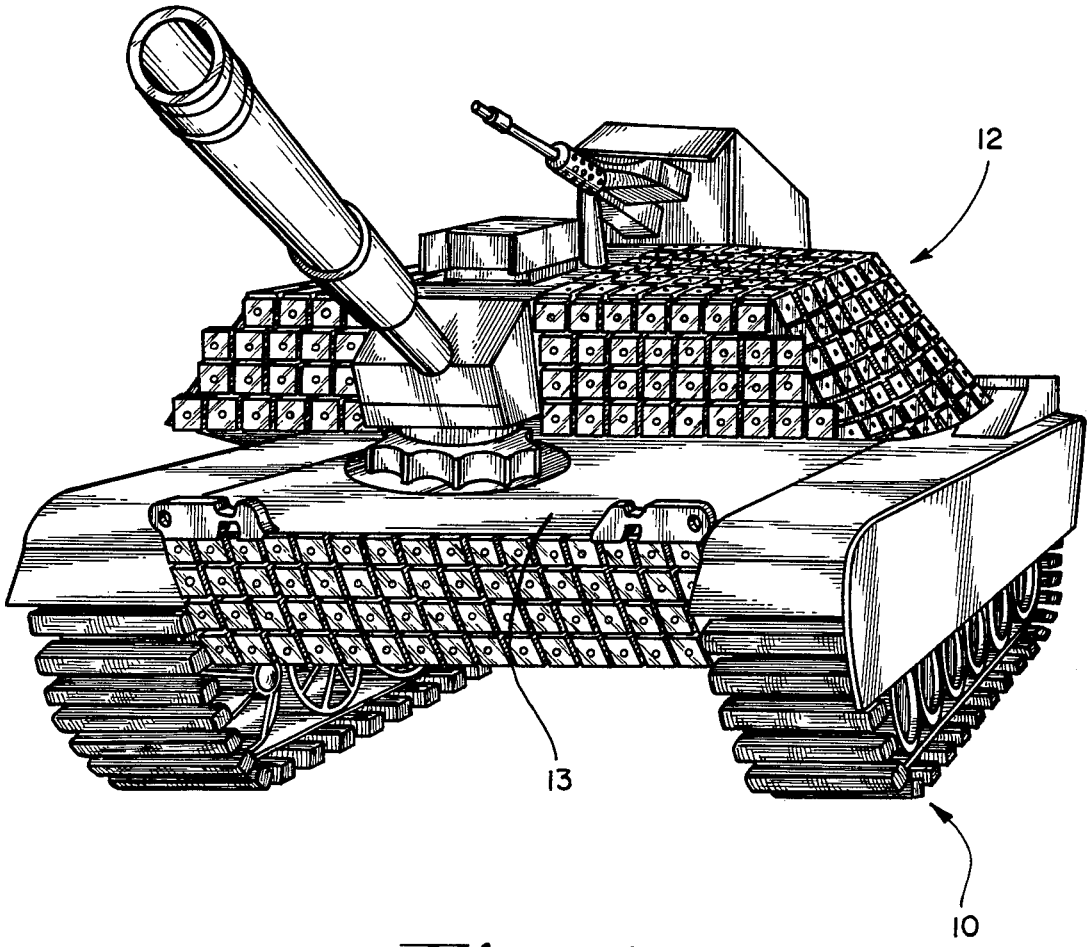
FIG. 1 is a front and side perspective view of a tank showing placed thereon a series of the active armor plates.
Figure 2A:
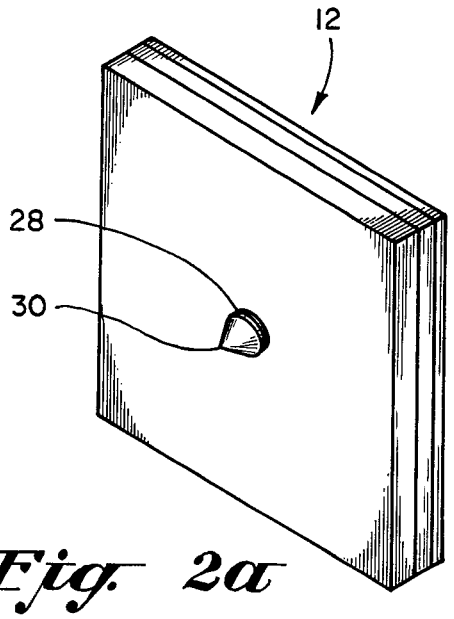
Figure 2B:
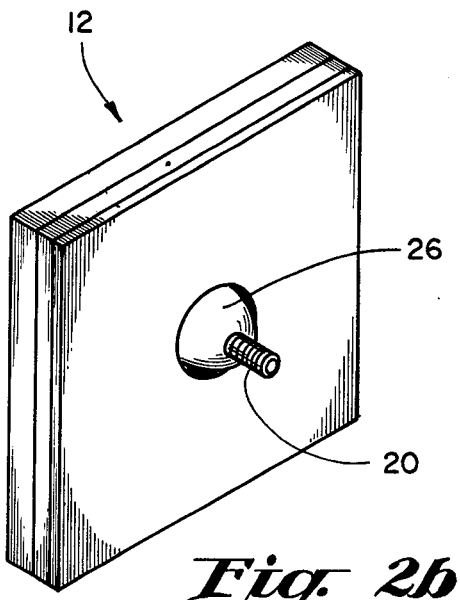

Referring now to FIG. 1, armored tank 10 is shown having a plurality of armor plates 12 mounted to tank surface 13. Again, it is stressed that while the instant invention is shown in the drawings as applied to a tank armor surface, it is anticipated that the active armor described herein could be applied to other types of personnel carriers, vehicles, ships, or even aircraft. It should be noted that in FIG. 1 the spacing of the plates 12 is shown such that the plates 12 are substantially adjacent one another. Slight gaps are left between the plates 12 to allow individual plates to react appropriately to the impact of an anti-tank round. FIGS. *2a* and *2b* show in perspective view an armor plate 12. Plate 12 has three layers consisting of three independent tiles adhered together. These layers will be described more fully below. Elongated plug 28 has pointed end 30 and is shown centrally located in FIG. 2. Plug 28 projects out of the outermost mounted tile and provides a deflection means against an impact on the center of the armor plate.

FIGS. 3 and 5 illustrate the front and back views of a single armor plate 12. Plate 12 is shown in rear view in FIG. 5 having centrally located spacer 26 and threaded bolt 20. Plate 12 is shown in FIG. 3 having elongated plug 28 centrally located thereon. Elongated plug 28 is receivable in opening 29 which extends through the depth of the plate.

As shown in FIG. 4, plate 12 comprises three separate tiles adhered together. Tile 14 is the central tile and is shown in FIG. 4 as resting adjacent bolt 20. Tile 14 has a front planar section 15 and a back planar section 17. Tile 14 is comprised of a dense material such as steel and in one embodiment is approximately a half-inch in depth. Bolt 20 has head 22 with flat section 23. Bolt 20 further has threaded end 24. Bolt 20 is made of a dense material such as steel but is designed to be relatively brittle. Tile 16 is the outermost tile and is adhered to the front planar surface 15 of tile 14 and extends over the area of front planar section 15. Tile 16 may be comprised of any suitable soft, elastic material. In the embodiment shown in FIG. 4, tile 16 is shaded for copper and approximately one-and-a-half inches wide. Other suitable materials would consist of bronze, a metal alloy such as aluminum alloy or even a polymer such as plastic. Tile 18 is secured to the back planar side 17 of tile 14. Tile 18 is comprised of a thermally dissipating material such as ceramic. Opening 29 is centrally located through tile 14 and tile 16. Opening 29 receives elongated plug 28 which is fixed adjacent flat section 23 of bolt 20. Elongated plug 28 has pointed end section 30 thereon. The elongated plug 28 is received into tile 16 and 14 such that the pointed end 30 protrudes from the end of tile 16. Plug 28 has at its opposite end flat section 32 which rests adjacent the flat head section 23 of bolt 20. Plug 28 is made of a steel or other dense material and is friction fitted into opening 29.

In FIG. 4 spacer 26 is shown disposed between the bolt head 22 and the tank armor surface 13. Spacer 26 has an outer, bowl like, convex shape and is arranged such that the convex shape is adjacent tank armor surface 13. Spacer 26 is made of a steel or dense material welded or fused to the back planar side 17 of tile 14.

As shown in FIG. 4, pointed end 30 of elongated plug 28 extends past the termination of tile 16. Elongated plug 28 with pointed end 30 is provided in the event of a central strike by a projectile onto the armor plate 12. Such a central strike without the presence of pointed plug 28 might impact directly through the tank armor if its line of flight was axial to the central axis of bolt 20. While this is unlikely, provision of plug 28 with pointed end 30 will serve to deflect any such central strike. A deflected sabot round will then be imbedded in the soft material and react as described below.

Figure 6A:
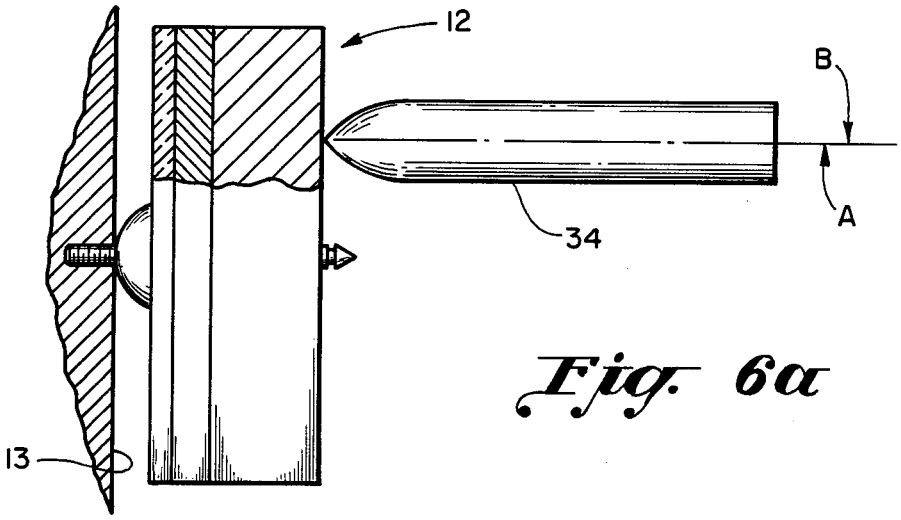
Figure 6B:
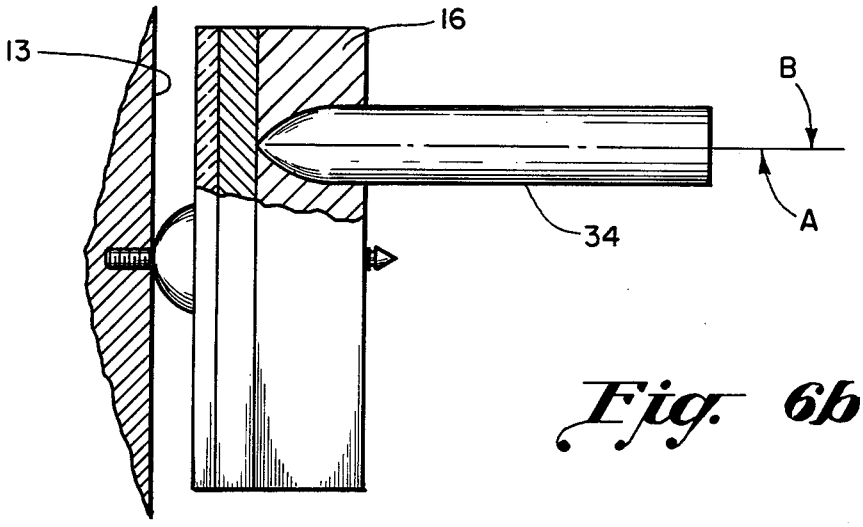
Figure 6C:
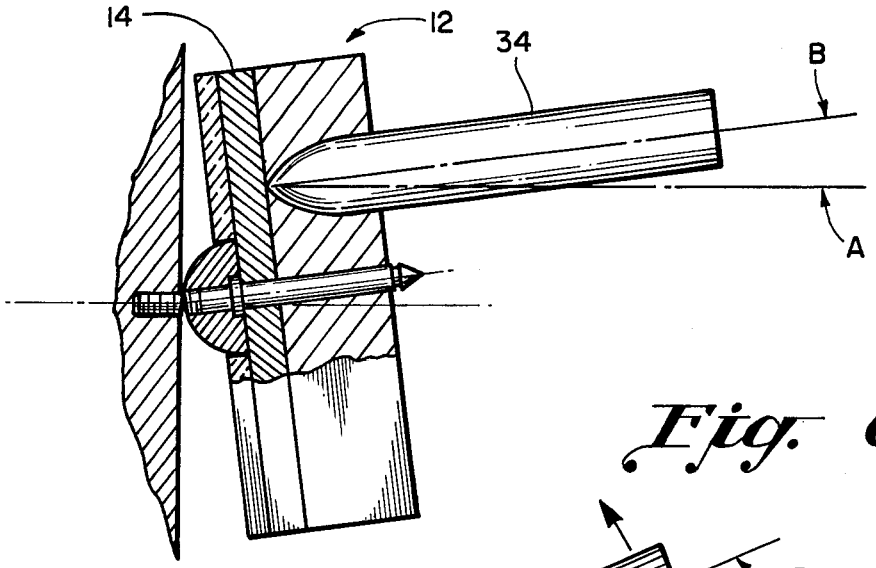
Figure 6D:
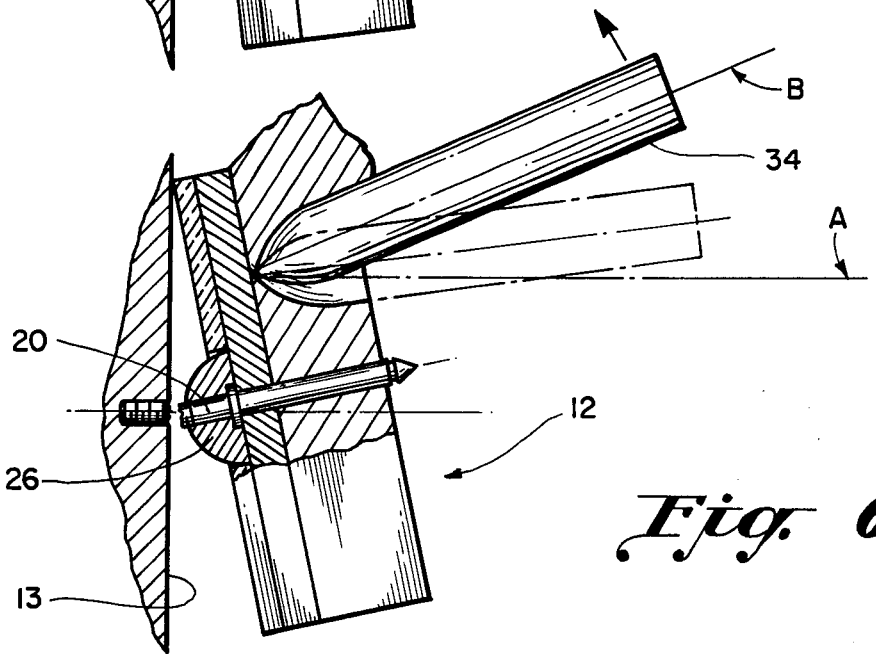
Figure 6E:
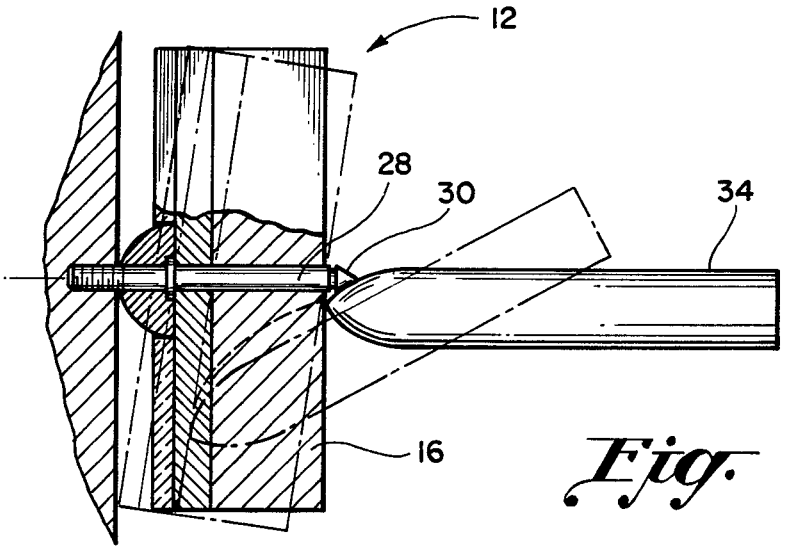

The spacer 26 provides a cup-shaped area against which the plate 12 will rotate on the surface of the tank when struck by an anti-tank projectile. This rotation of the plate 12 will fracture bolt 20 and cause the desired effect of disorienting the projectile from its line of flight. This disorientation removes the central axis of the projectile from the line of flight of the projectile and causes it to flip harmlessly out of the way as shown in the sequence of FIG. 6. FIG. 6*a* illustrates sabot round 34 striking armor plate 12. FIG. 6*b* illustrates the projectile 34 entering the soft tile material 16 and striking the hard armor tile 14. FIG. 6*c* illustrates the rotation of armor plate 12 as the energy of the sabot round is imparted to the hard tile 14. Flight vector A illustrates the line of flight of the sabot round prior to its striking the hard tile 14. Prior to striking plate 12 the flight vector A and the central axis of projectile 34 are the same. Vector B illustrates the angle of the central axis of the sabot round after striking tile 14. It is seen that since the central axis of the sabot round and line of flight of the sabot round 34 has been disoriented by the movement of the plate 12, the round will now flip out of the way as shown in FIG. 6*d*. As the round 34 flips its center of gravity is moved out of the line of flight A and the projectile is no longer effective. FIG. 6*d* also illustrates the bolt 20 breaking from the force of the sabot round 34. It should be noted that bolt 20 is relatively brittle and breaks prior to the penetration of the sabot round 34 into the steel tile 14. Also, spacer 26 further helps to insure that the bolt fractures as spacer 26 causes plate 12 to rotate about its convex outer shape upon impact by the sabot round 34. Bolt 20 is designed such that the material hardness and diameter of the bolt, in conjunction with the steel spacer 26, cooperate to allow the rotational force on the plate 12 by a sabot round to fracture the bolt prior to penetration of steel tile 14 by round 34. FIG. 6*e* illustrates a sabot round 34 centrally striking armor plate 12 on plug 28 at pointed end 30. Sabot round 34 is deflected off of end 30 and into tile 16 where the plate 12 then will react as above described.

Figure 7A:
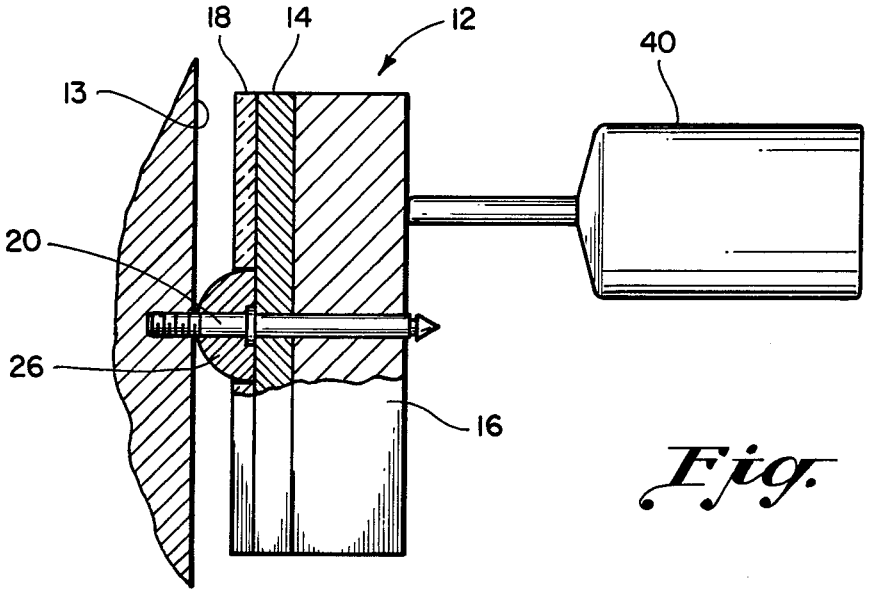
Figure 7B:
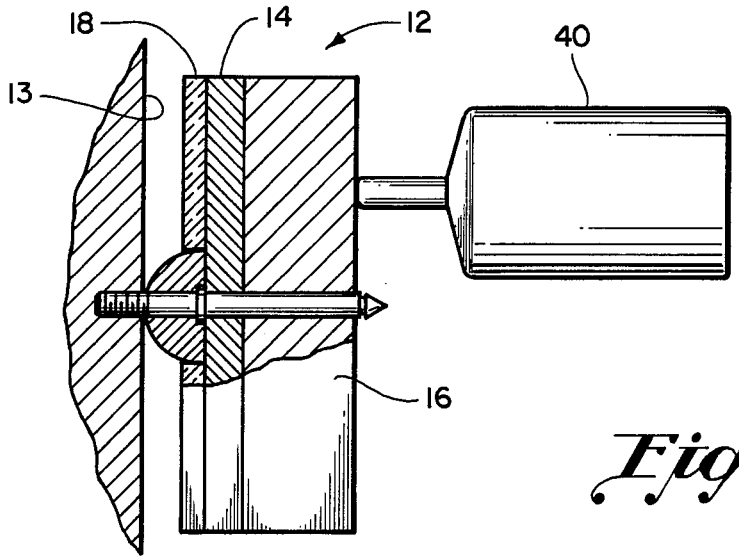

FIG. 7 illustrates in sequence the shaped charge striking tile 12. Shaped charge 40 is shown in FIG. 7*a* as striking soft tile 16. The shaped charge then detonates and releases a concentrated heat energy designed to burn through the armor surface 13 of the tank. The success of this charge 40 depends upon its ability to maintain contact with the tank surface 13 and to concentrate a high energy temperature charge on a small area of the tank surface 13. By striking plate 12 the shaped charge 40 is removed a predetermined distance from tank surface 13 by virtue of the spacer 26 and the bolt 20. Further, the concentrated thermal energy of shaped charge 40 must burn through not only tile 16 but also through steel tile 14. Once it burns through steel tile 14 the concentrated thermal energy will strike the heat dissipating tile 18 whereupon the heat is dissipated over the entire area of the tile 18. This renders the shaped charge 40 practically useless. In addition, an additional safeguard is maintained in that the plate is removed a predetermined distance from tank surface 13. Even if some of the thermal energy burns through the thermal tile 18 the shaped charge will not maintain a close enough contact to tank surface 13 in order to concentrate the thermal energy to burn through the surface 13. This is shown in FIG. 7*b*. Thus, the instant invention provides a dual means to protect the armor surface 13 from the disasterous effects of a strike from a shaped charge. The thermally dissipating tile 18 will deconcentrate the thermal energy of the projectile over its area. Also, if the shaped charge 40 burns through the tile 18, the distance between the tile 18 and tank surface will prevent the charge 40 from burning into the interior of the tank.

Figure 8A:
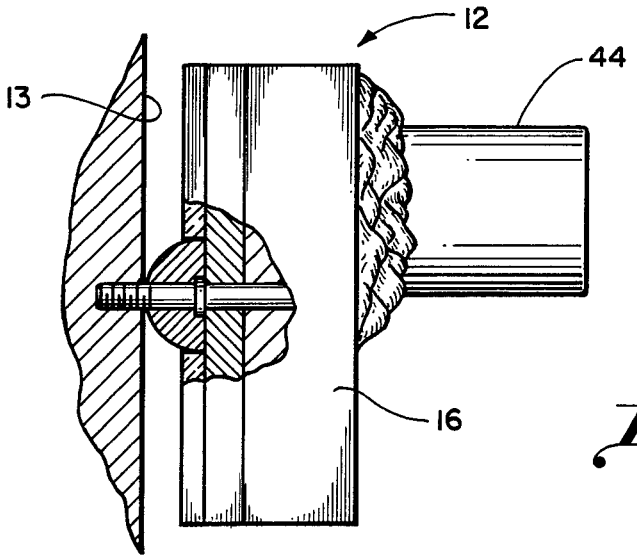
Figure 8B:
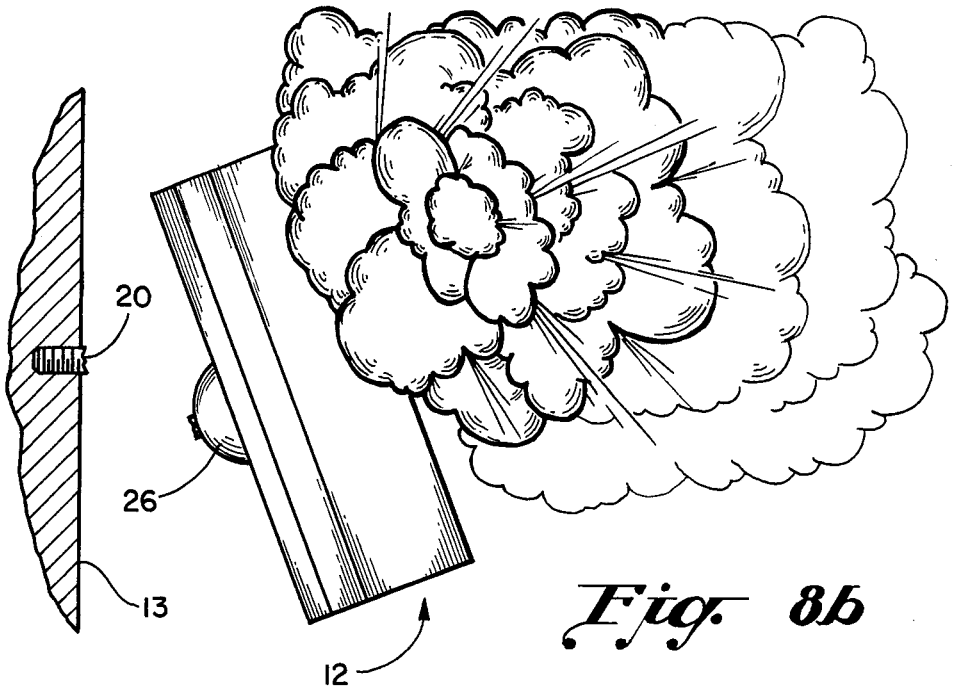

FIGS. 8*a* and 8*b* illustrate the HESH charge striking armor plate 12. HESH charge 44 is shown adhering to the outer tile 16. Once adhered to plate 12 the plastic explosive detonates. The success of the HESH charge 44 depends upon its ability to adhere directly to the tank surface 13 and explode thereby setting up a shock wave which is transmitted through the tank wall and causes the inner tank wall to fracture and explode. By maintaining armor plate 12 a predetermined distance from tank surface 13 the HESH charge 44 cannot make the required contact with the tank surface 13. Once the plastic explosive of the HESH charge 44 detonates, the plate 12 or a series of plates 12 may be blown off of the tank wall 13. This may expose a small area of the tank surface 13 to additional attack, however, it would take an exceptional marksman with an anti-tank weapon to deliver a second HESH charge to that open area. FIG. 8*a* illustrates the HESH charge 44 adhering to armor plate 12 and FIG. 8*b* illustrates the explosive effect of the HESH charge 44 after detonation. Note that surface 13 has not been damaged.

FIG. 9 shows an exploded view of the component parts of the plate 12. Referring back to FIG. 4, plate 12 is shown in side view. In the best mode of practicing the invention it is felt that the plate 12 should be square with the length and width dimensions approximately six inches each. This allows the plates 12 to be placed side by side with a minimum tank surface 13 left exposed. Also, this size allows the plates to better match the contours of the outer tank walls. Further, if one plate is broken by the impact of a projectile, it will leave only a six-inch square area exposed and unprotected. A one-and-one-half inch depth should be adequate for tile 16, however, this depth may vary due to the type of material selected for this tile 16. As indicated above, tile 14 is about one-half inch in depth, although this dimension may vary depending again on the density of the material selected. Tile 18 is approximately one-quarter inch thick and again, this dimension may vary depending on the thermal dissipation properties of the ceramic material. Tiles 16 and 18 are anticipated as having the same length and width as tile 14. The predetermined distance between tank surface 13 and tile 18 should be at least three-fourths of an inch. This distance allows enough movement of the armor plate 12 upon impact to disorient a projectile. Also, this distance provides clearance to dissipate the shaped charge's thermal energy. This distance may vary as a function of the armor plate's size and materials selection.

While it is anticipated that the best mode has been described, alternative embodiments which meet the scope and spirit of the above described invention can be contemplated. Thus, while it is felt that the best mode for the armor plate 12 would be of a rectangular or even square design other geometric shapes could be used. Also, while it is felt that the combination of the materials above described produces the best protection, it is possible that only one or two materials may be used to achieve satisfactory protection. Hard steel tile 14 is anticipated as the mainstay of the plate 12 components, however, tile 18 may be eliminated leaving only tile 14 and 16 as the plate 12. This would be a suitable arrangement where the likelihood of a shaped charge being used is small. Also, various combinations of materials may be used to produce differing results with respect to armor plate 12. Likewise, a mounting means other than the threaded bolt and fastener may be used such that the plate could tip without actually breaking off of the tank surface 13. This would prevent the exposure of tank surface 13 when an individual or series of armor plates have been blown off. Also, it would eliminate the need for replacing blown off plates with new plates. Further, bolt 20 could be rectangular shaped in cross section up to the point of the threaded section 24 to allow easy removal of a fractured bolt 20 from the tank surface for replacement with a new armor plate.

The above described invention is a novel method of providing an armament for a tank or other personnel carrier. It is light, easily maintained, and relatively inexpensive considering the cost of vehicle carriers or tanks. Broken or damaged armor plates may be replaced by simply unscrewing the bolt 20 from the tank surface 13 and screwing in a new plate 12. The plates are designed such that their dimensions are small enough to allow placement and conformity to the varying surface contours of the tank surface 13.

In view of the above alternative embodiments and others, this invention is not limited to the particular details of construction of the device depicted. Other modifications and applications may be contemplated as indicated above. Some have been described above. Certain other changes may be made in the above described apparatus without departing from the true spirit and scope of the invention herein involved. It is intended, therefore, that the subject matter in the above depiction shall be interpreted as illustrative and not in a limiting sense.

I claim:

1. An apparatus for protecting a surface from a projectile comprising a series of armor plates disposed substantially adjacent one another and substantially covering the surface to be protected; each armor plate mounted to the surface and each armor plate having an individual means for mounting the armor plate to the surface, each individual mounting means comprising a spacer having two ends and an opening therethrough connecting each of said ends, one of said ends having a rounded exterior, a bolt having two ends and secured at one end to the plate substantially at the center thereof and having the other bolt end projecting outward from the plate and secured to the surface to be protected, the outwardly projecting bolt end disposed in the opening of said spacer such that the spacer is disposed between the plate and the surface with the rounded exterior end abutting the surface; each said mounting means maintaining the armor plate a predetermined distance from the surface and maintaining the armor plate substantially parallel to the immediate surface underlying the armor plate, said mounting means breakble upon the impact of a projectile onto the armor plate prior to substantial penetration of the projectile into the armor plate.

2. An apparatus for protecting a surface against a projectile comprising a plate having a front tile, an intermediate tile and a back tile; and a means for mounting said plate to the surface, said front tile comprising a relatively malleable material, said intermediate tile comprising a relatively dense material and having two, substantially parallel sides, the back tile comprising a material having thermal dissipating properties, said back tile secured to one side of the intermediate tile and said front tile secured to the other side of the intermediate tile; said plate mounting means connected substantially at the center of the intermediate tile and comprising a bolt having a head section and a threaded section; said bolt head section disposed through a centrally located opening in the back tile and secured to the intermediate tile such that the threaded bolt section projects outwardly from the plate and is mateable with a threaded opening in the surface to be protected; a spacer having a substantially rounded shape and having an opening located therethrough, said spacer disposed over the threaded bolt section through said opening such that a rounded portion of the spacer rests against the surface to be protected when the threaded bolt section is threaded into the surface, said spacer maintaining the plate substantially parallel to and a predetermined distance from the surface; said bolt designed such that the energy required to fracture the bolt is less than the energy required to penetrate the intermediate tile of the plate when the plate is struck by a projectile.

3. The apparatus of claim 2 wherein said tiles are substantially rectangular.

4. The apparatus of claim 2 wherein the intermediate tile comprises a dense material such as steel.

5. The apparatus of claim 2 wherein the front tile comprises a metal such as copper.

6. The apparatus of claim 2 wherein the front tile comprises a polymer such as plastic.

7. The apparatus of claim 2 wherein the back tile comprises a thermally dissipating material such as ceramic.

8. The apparatus of claim 2 where the front tile and the intermediate tile each include an opening in axial alignment with said plate mounting means and an elongated plug comprising a relatively dense material and having a pointed end, said plug secured in said opening in axial alignment with said plate mounting means such that said pointed end projects out of said opening and away from the surface to be protected.

9. The apparatus of claim 2 wherein a plurality of plates are arranged substantially adjacent one another over a surface to be protected; said plates substantially conforming to the contour of said surface.

10. An apparatus for protecting a surface from a projectile comprising a series of armor plates disposed substantially adjacent one another and substantially covering the surface to be protected; each said plate comprising a first tile of a relatively malleable material, a second tile of a relatively dense material, and a third tile of a thermally dissipating material, said second tile having a front planar-section and a rear planar section where where said first tile is secured to the front planar section and the third tile is secured to the rear planar section; each armor plate mounted to the surface and each armor plate having an individual means for mounting the armor plate to the surface; each individual mounting means comprising a spacer having two ends and an opening therethrough connecting each of said ends, one of said ends having a convex exterior, a bolt having two ends and secured at one end to the rear planar portion of the second tile substantially at the center thereof, and having said other bolt end projecting outward from the plate through an opening in the third tile; the outwardly projecting bolt end disposed in the opening of said spacer such that the spacer is between the plate and the surface with the convex exterior abutting the surface; each mounting means maintaining the armor plate a predetermined distance from the surface and maintaining the armor plate substantially parallel to the immediate surface underlying the armor plate, said mounting means breakable upon the impact of a projectile onto the armor plate prior to substantial penetration of the projectile into the armor plate.

11. The apparatus of claim 10 wherein the armor plates each comprise a substantially rectangular shape.

12. The apparatus of claim 10 wherein the second tile comprises a relatively dense material such as steel.

13. The apparatus of claim 10 wherein the first tile comprises a relatively malleable material such as copper.

14. The apparatus of claim 10 wherein the first tile comprises a malleable material such as a metal alloy.

15. The apparatus of claim 10 wherein the first tile comprises a relatively malleable material such as a polymer.

* * * * *